US007296358B1

(12) United States Patent
Murphy et al.

(10) Patent No.: US 7,296,358 B1
(45) Date of Patent: Nov. 20, 2007

(54) DIGITAL VERTICAL LEVEL INDICATOR FOR IMPROVING THE AIM OF PROJECTILE LAUNCHING DEVICES

(76) Inventors: Patrick J. Murphy, 209 Heritage Dr., Tullahoma, TN (US) 37388; Matthew A. Johnson, 265 Hill Top Cir., Tullahoma, TN (US) 37388; Michael C. Murphy, 209 Heritage Dr., Tullahoma, TN (US) 37388

( * ) Notice: Subject to any disclaimer, the term of this patent is extended or adjusted under 35 U.S.C. 154(b) by 0 days.

(21) Appl. No.: 11/040,067

(22) Filed: Jan. 21, 2005

Related U.S. Application Data

(60) Provisional application No. 60/538,015, filed on Jan. 21, 2004.

(51) Int. Cl.
*F41G 1/467* (2006.01)

(52) U.S. Cl. ..... 33/265

(58) Field of Classification Search ..... 33/265
See application file for complete search history.

(56) References Cited

U.S. PATENT DOCUMENTS

| | | | | |
|---|---|---|---|---|
| 4,567,668 | A * | 2/1986 | King et al. | 33/265 |
| 5,339,227 | A * | 8/1994 | Jones | 33/265 |
| 5,524,351 | A * | 6/1996 | Pinson et al. | 33/265 |
| 5,634,278 | A * | 6/1997 | London | 33/265 |
| 5,850,700 | A * | 12/1998 | Capson et al. | 33/265 |
| 6,539,637 | B1 * | 4/2003 | Hollabaugh | 33/265 |

FOREIGN PATENT DOCUMENTS

| | | |
|---|---|---|
| CA | 2458930 | 10/2003 |
| GB | 2395251 | 5/2004 |
| WO | WO 03/029745 A2 | 9/2002 |
| WO | WO 2004099700 A1 | 11/2004 |

OTHER PUBLICATIONS

U.S. Appl. No. 60/538,015, filed Jan. 21, 2004, by Patrick Murphy.
U.S. Appl. No. 60,326,828, filed Oct. 3, 2001, Williamson et al.
U.S. Appl. No. 10/808,197, filed Mar. 24, 2004, Williamson et al.

* cited by examiner

*Primary Examiner*—Christopher W. Fulton
(74) *Attorney, Agent, or Firm*—Waddey & Patterson, P.C.; Howard H. Bayless

(57) ABSTRACT

An electronic vertical angle sensing and indicating device for use on aiming systems is provided for bow sights and for other aiming sights for projectile launchers. Improved vertical level measurement and display minimizes the left-right drift of a projectile by sensing and indicating to the user when the projectile launcher is tilted slightly prior to release of the projectile. The vertical level indicator is easily viewed within the field of direct or near direct vision and focus of the eye in a reduced profile that does not distract the operator from the task of accurately aiming the projectile is provided. One embodiment of the present invention positions the signal indicators in the far-field of view of the eye, so that all of the signal indicators, the sighting means and the distant target being viewed are simultaneously in focus or near-focus.

10 Claims, 7 Drawing Sheets

Block Diagram of Digital Vertical Level Indicator

Variations in Accelerometer Output Pulse

DIGITAL VERTICAL LEVEL INDICATOR FOR IMPROVING THE AIM OF PROJECTILE LAUNCHING DEVICES

CROSS-REFERENCES TO RELATED APPLICATIONS

This application is a Non-Provisional Utility application which claims benefit of U.S. Patent Application Ser. No. 60/538,015, filed Jan. 21, 2004, now abandoned, entitled "Digital Level Indicator for Improving the Aim of Projectile Launching Devices" which is hereby incorporated by reference.

BACKGROUND OF THE INVENTION

The present invention relates generally to electronic angle sensing devices. More particularly, this invention pertains to electronic vertical angle sensing and indicating devices for use on aiming systems associated with projectile launchers.

Archers have relied for many years upon pin sights for aiming their bows. Typically, these pins are adjusted to accurately direct an arrow trajectory toward a target at a specific distance from the archer. Each pin is set for a specific distance, for example, 20, 30, and 40 yards. It is assumed by the archer that, while setting and aligning the pins on his sight, the bow riser (the frame of the bow that includes the handle) is vertical and that the arrow is launched with only forward and upward components of velocity. If the riser is canted to the left or right, i.e., tilted about a horizontal axis directed toward a target, a small sideway component of velocity is imparted to the arrow, resulting in a left or right transverse horizontal drift, respectively, as it flies toward its target. Referring now to FIG. 1, an illustration of a bow aimed at a target shows the target direction and trajectory of an arrow in relation to the coordinate axes used to describe the effect of tilting the bow in the plane perpendicular to the target direction. Referring now to FIG. 2 a detailed illustration of the components of a bow relevant to the problem of bow canting shows the positioning of a bow sight-mounted level sensor on the bow.

Prior developments in this area of angle sensing devices for use on aiming systems associated with projectile launchers include bubble-type levels, similar to those used on carpenters levels, and mechanical pendulum devices. Typically, if an archer wants to ensure that the bow riser is vertical, a small bubble-type level is attached horizontally to the base of a pin sight housing within the field of view of the peep sight attached to the string. When the bubble-type level indicates that the base of the pin sight housing is level, the riser of the bow will have not be canted and will have a zero cant angle (i.e. a cant angle of 0°). The condition of zero cant angle will be referred to as being in "vertical level". While bubble-type levels perform reasonably well for short trajectory shooting situations, they are somewhat limited when the arrow trajectory is long.

Canting is also of concern when firing a rifle, grenade launcher, or any other projectile-firing device. The effect of canting angle on the accuracy of a projectile trajectory can be better understood by examining the geometry associated with the launch of a projectile. Consider a coordinate system in which the x-axis is defined as the forward-looking horizontal line from the projectile launcher to the target, the y-axis is the vertical direction, and the z-axis is directed horizontally to the right of the launcher. A projectile is normally launched in the x-y plane with a launch angle, $\Theta$, above the x-axis. The cant angle, $\Phi$, represents the tilt in the y-z plane about the x-axis. When the projectile launcher is canted about the x-axis, the projectile is given a small component of motion along the z-axis, which causes the projectile to drift left or right of the intended target. Simultaneously, the cant angle causes the launch angle to be reduced slightly, causing the projectile the fall short.

Aiming systems using either bubble-type levels or mechanical pendulum devices are bulky and cumbersome when used with portable projectile launchers such as bows and firearms. For most projectile launchers, it is desirable that the weight of any accessory be kept to a minimum. This is especially true when an angle sensing device is attached to bowsights, because of the high amount of shock and vibration generated during the process of shooting of an arrow. The construction of typical bowsights requires that the electronic angle sensing device be mounted on a cantilevered beam of some type, which is in turn attached to the bow riser. Excessive mass attached to such a bowsight can cause extreme stresses on the sight frame, eventually causing the bowsight attachment point to fatigue and fracture.

What is needed, then, is a lightweight vertical level sensing and indicating system that can be attached directly to the housing of a bowsight.

Recent developments in the area of electronic angle sensing devices for use on aiming systems associated with projectile launchers include incorporating a "binary" (i.e. in vertical level or not in vertical level) indication of vertical level with the signal indicator housed on the eyepiece. One such binary device locates the signal indicator in the peripheral field-of-view out of the focal plane of the reticle. This requires the user to view the signal indicators to rely on peripheral vision and presents a blurred near-field illumination. While providing a binary indication of vertical level, these devices do not provide for analog or digital output signals that are proportional to the cant angle.

What is needed, then, is a small, lightweight, affordable vertical level indicator that incorporates a miniaturized, low-power electronic angle sensing device to provide an output signal that is proportional to the cant angle for use with aiming systems associated with projectile launchers.

BRIEF SUMMARY OF THE INVENTION

In accordance with one aspect of the present invention, an electronic vertical angle sensing and indicating device for use on aiming systems is provided for bow sights and for other aiming sights for projectile launchers such as firearms and grenade launchers, etc. Improved vertical level measurement and display minimizes the left-right drift of a projectile by sensing and indicating to the user when the projectile launcher is tilted slightly prior to release of the projectile. Additionally, improved vertical level indications provided by the present invention will improve the range accuracy by ensuring that the vertical launch angle of the projectile is maintained at the vertical level to which the sights were initially set.

In accordance with one aspect of the present invention, a vertical level indicator that is easily viewed within the field of direct or near direct vision and focus of the eye in a reduced profile that does not distract the operator from the task of accurately aiming the projectile is provided. One embodiment of the present invention positions the signal indicators in the far-field of view of the eye, so that all of the signal indicators, the sighting means and the distant target being viewed are simultaneously in focus or near-focus.

An advantage of at least one embodiment of the present invention is an improvement in the aiming capability of bows and other projectile launcher sighting devices is achieved.

Another advantage of at least one embodiment of the present invention is that the miniature, light weight vertical level sensor and indicator can be conveniently attached to a bow riser or sight, or to a riflescope or red dot reflex sight, or to a leaf sight such as used on a grenade launcher.

Yet another advantage of at least one embodiment of the present invention is that is the miniature, light weight vertical level sensor and indicator provides a cost-effective means of providing vertical level indication for bow and other projectile launcher sights.

A further advantage of at least one embodiment of the present invention is the improvement in accuracy that is provided by the vertical level sensor and indicator's electronic method of providing vertical level indication as compared to existing mechanical (i.e., bubble-type) levels.

A further advantage of at least one embodiment of the present invention is that the present invention provides a continuous vertical level signal and indication that is proportional to the cant angle, or multiple step-level signal and indication that is proportional to the cant angle.

A further advantage of at least one embodiment of the present invention is the provision of a signal indication which directly illuminates the pin of a bow-sight by incorporating fluorescent fiber optics or other type of fluorescent material, thus causing the brightness of the aiming pin being used by an archer to vary according to the degree of cant in the bow riser, or causing the brightness of the pin to turn on and off in response to the riser angle being either within or outside, respectively, of the acceptable cant angle determined by the user.

A further advantage of at least one embodiment of the present invention is the provision of a signal indication that lies beyond the near-field of the eye, and can be comfortably viewed by the user as the user is focused on a distant target. Preferred embodiments provide for the location of the sensor and signal indicators to be on a bow-mounted pin sight, an iron sight of a firearm, or in the reticle plane of a riflescope.

A further advantage of at least one embodiment of the present invention is the provision of an analog or digital sensor output that can be used to actively control, through an electronic feedback control loop, the positioning of the pins on a bowsight, the iron sight of a firearm, a leaf sight as used in a grenade launcher, or the targeting reticle in a riflescope.

A further advantage of at least one embodiment of the present invention is the provision of a user interface for determining when the launcher is vertical, including, for example, the user selected option of displaying either single or multiple indicator lights to the user.

DETAILED DESCRIPTION OF THE INVENTION

I. Accelerometer Operation

Figure 6:
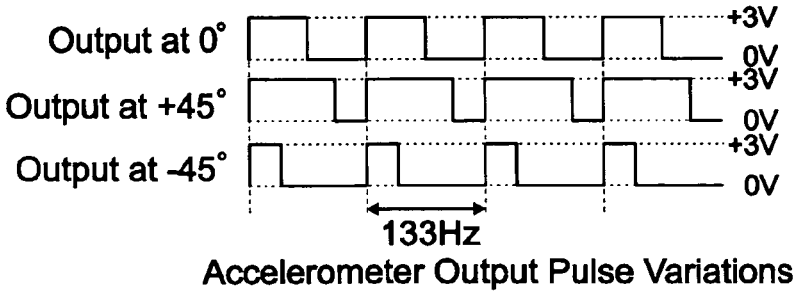
FIG. 6 is a wave form representation of the output pulse variations of the accelerometer used in the embodiment of this invention shown in FIG. 7.
Figure 7:
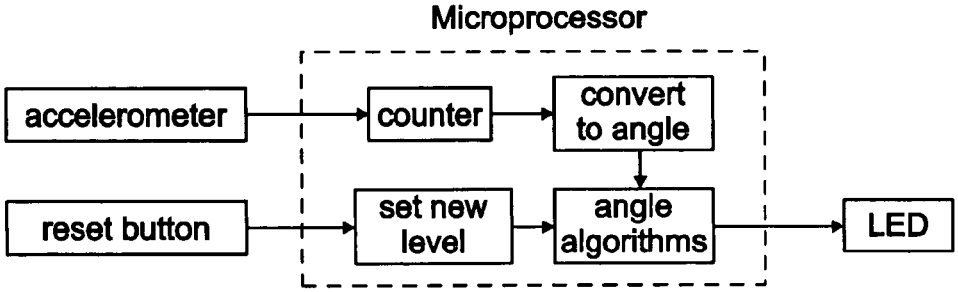
FIG. 7 is a schematic block diagram representation of the digital vertical level sensing device of a preferred embodiment of this invention.

Referring now to FIG. 7, a schematic block diagram representation of the digital vertical level sensing device of a preferred embodiment of this invention is shown. An electronic accelerometer is shown in communication with a microprocessor. Suitable electronic accelerometers include both analog or digital electronic angle sensors with output signals corresponding to tilt angle, or electronic tilt angle sensing switches (two-state device, with one output for indicating level and another output for indicating non-level). According to the present invention, these accelerometers can be incorporated into devices for measuring and displaying cant angles for projectile launcher applications. In the preferred embodiment of the present invention, a digital electronic accelerometer outputs a continuous signal of digital pulses with a frequency anywhere between 1 Hz–1 MHz. When the accelerometer is parallel to the horizontal plane, corresponding to the condition of zero cant angle, the output pulse has a duty cycle of 50%, meaning the pulse is high for exactly half of the pulse period. In general, duty cycle is defined as the pulse width divided by the period of one one/off cycle multiplied by 100%. The high pulse width increases or decreases continuously as a function of the tilt angle of the accelerometer with respect to the horizontal plane. Referring now to FIG. 6, a wave pattern of the output pulses from the accelerometer of one embodiment of the present invention is shown. At an angle of +45 degrees, the duty cycle is greater than 50%. At an angle of −45 degrees, the duty cycle is less than 50%. As the accelerometer is rotated about the x-axis so as to be closer to perpendicular to the horizontal plane, the resolution of the change in pulse width diminishes. In the vertical level applications such as the digital vertical indicator of the present invention, the most frequent and critical vertical angle measurements are made when the accelerometer is near-level with the horizontal plane and, thus, near a zero canting angle. When sensing these small-degree canting angles (less than + or −45 degrees from a zero canting angle), digital electronic accelerometers operate within the range providing the greatest accuracy. The lessening of accuracy at the extreme angles will not affect normal usage of this embodiment of the present invention.

II. Device Operation

Referring again to FIG. 7, the output pulses from the accelerometer are shown as inputs an internal counter/timer of a microprocessor. The high pulse width, hereinafter referred to as the "pulse width", of each period shown in FIG. 6 is measured as a function of counts, and the total period of one on/off cycle is also measured as a function of counts. Temperature effects on pulse width may be substantial, the related corrections are made by selected software and/or hardware as described below.

In one embodiment of the present invention, the electronic accelerometer or other suitable level sensor is angle-calibrated using a stepper motor with 0.9 degree motor steps. The resolution of the microprocessor's counter determines the resolution of the angle data. For example, if a 12-bit counter were used, and the 50% duty cycle pulse was set at 2048 counts, then there would be roughly a one thousand count increase/decrease in counts if the angle were increased/decreased by 80 degrees respectively. This would give an average resolution of (2000 counts)/(160 degrees) =12.5 counts per degree, or 0.08 degree resolution on average. The more extreme the angle, the larger the resolution, but for a plus or minus one degree desired resolution, this procedure will be adequate. Calibration data is stored in look up tables or other suitable media in communication with the microprocessor.

After the device is angle-calibrated, the microprocessor assigns an angle value for the counts data of the converted accelerometer output pulses. This is accomplished using some simple interpolation algorithms stored in suitable media or embodied in selected microprocessor hardware.

At the zero degree canting angle, corresponding to the condition where the projectile launcher is properly leveled, plus or minus some predetermined acceptable angular error range, the microprocessor provides an illumination signal for one or more external LEDs, or other visual or audio indicators, to signal the user that the device is level. In one alternative embodiment, a slight hysteresis will be added to the timing of the LED illumination pulse, or other indicator, so that the LED will not flicker on and off due to unwanted external vibration or instability of the projectile launcher operator that could cause rapid variations in the digital vertical level outputs.

Referring again to FIG. 7, a set/reset button is shown in communication with the microprocessor. The microprocessor is adapted to set and store a new angle trigger level for activating the LED level indicator upon receiving a signal from the set/rest button. In setting or resetting the desired angle trigger level, the user places the ballistic projectile launcher, and thus the attached digital vertical level indicator, at any desired cant angle. The user then presses the reset button which send a signal to the microprocessor. The microprocessor, through operation of a level angle algorithms and/or hardware, resets the angle trigger level for the LED. The LED will turn on only when the unit is within a predetermined range of the new angle. In one embodiment, the LED will turn on only when the unit is within plus or minus 1 degree of the new angle. This feature also allows users to calibrate their own zero level value to ensure that the unit is at its most accurate at the time of its use.

III. Temperature Effects and Corrections

Extreme changes in temperature can cause the accelerometer output signal period and high pulse width to vary, thus offsetting the canting angle value that would trigger the LED. Compensation for these temperature variances can be implemented using the high pulse width counts data. Changes in temperature affect the output pulse period and pulse width of the accelerometer. However, the temperature effects on both the pulse period and the pulse width are similar, and the ratio of the two can be used to determine a more temperature-stable output counts reading.

Figure 8:
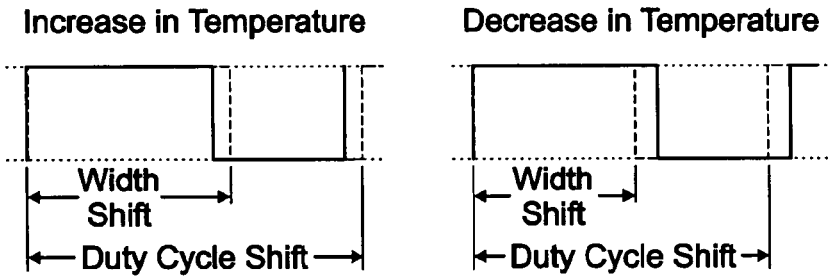
FIG. 8 is a wave form representation of the temperature variations of the output pulses of the accelerometer used in the embodiment of this invention shown in FIG. 7.

FIG. 8 shows an exemplar wave form of the pulse shifts due to temperature. If the pulse width at room temperature is $P_{room}$, the pulse period at room temperature is $D_{room}$, the pulse width and pulse period at a higher temperature are $P_{high}$ and $D_{high}$ respectively, and the pulse width and pulse period at a lower temperature are $P_{low}$ and $D_{low}$, respectively, the following should hold true:

$$P_{room}/D_{room}=P_{high}/D_{high}=P_{low}/D_{low}$$

The microprocessor of one embodiment includes algorithms that determine the ratio of the high pulse width to the pulse period and calculate a temperature correction to the pulse measurements for pulse drifts due to temperature.

IV. User Interface

Figure 9A:
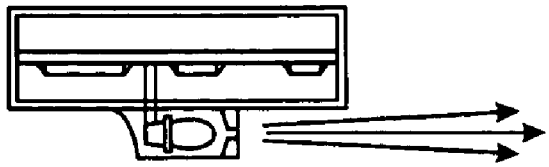
FIG. 9*a* is an illustration of the digital level indicator incorporating a single indicator light used in one embodiment of this invention.

In one preferred embodiment of the invention shown schematically in FIG. 9*a*, the digital vertical level indicator includes a single light source, either incandescent or LED, that is activated microprocessor at the moment the accelerometer sensor senses an angle that is equal to the angle trigger level set in the microprocessor, to within some preset range of error. In one embodiment that preset range is ±1 degree.

Figure 9B:
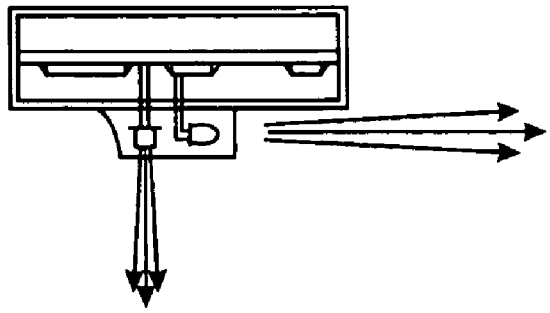
FIG. 9*b* is an illustration of the digital level indicator incorporating a multiplicity of signal indicator lights comprising blue, violet or ultraviolet LEDs for use in illuminating fluorescent pins, used in one embodiment of this invention.

In one preferred embodiment of the invention, the indicator light is configured to illuminate directly towards the eye of the operator. In an alternative preferred embodiment, the indicator light is configured to indirectly signal the operator by illuminating the fiber optic pins of a bow sight or the cross-hair of a riflescope as shown in FIG. 9*b*. FIG. 9*b* shows a digital vertical level indicator incorporating a multiplicity of signal indicator lights comprising blue, violet or ultraviolet LEDs for use in illuminating fluorescent pins, used in one embodiment of this invention. When the sight is out-of-level beyond the preset range of error, the light source would dim or shut off. Preferably the indicator light will be located in the peripheral field of vision of the eye, but at a great enough distance from the eye that the eye will be able to distinctly recognize the indicator light. Positioning the indicator lights in the near-field of the eye (within the distance of closest focus of the eye) will cause the indicator lights to be blurred and potentially unnoticed by the user at times of extreme concentration on the target. For a bow, the level indicators would preferentially be located on or near the bowsight, which is typically located at approximately arm's length away from the eye. The digital vertical level indicator as used, for example, on a leaf sight of a grenade launcher, would preferentially be used on or near the leaf sight, also located approximately at arm's length from the eye.

The preferred embodiment of this sensor as applied to a firearm equipped with a telescopic or red dot reflex type sight would be in the focal plane of the objective lens or at the focal plane of the reticle or crosshair. Locating the signal indicators in the focal plane of the reticle or crosshair would enable the user to simultaneously see a focused image of the signal indicator(s) and the target without having to change focus of the eye.

Figure 4:
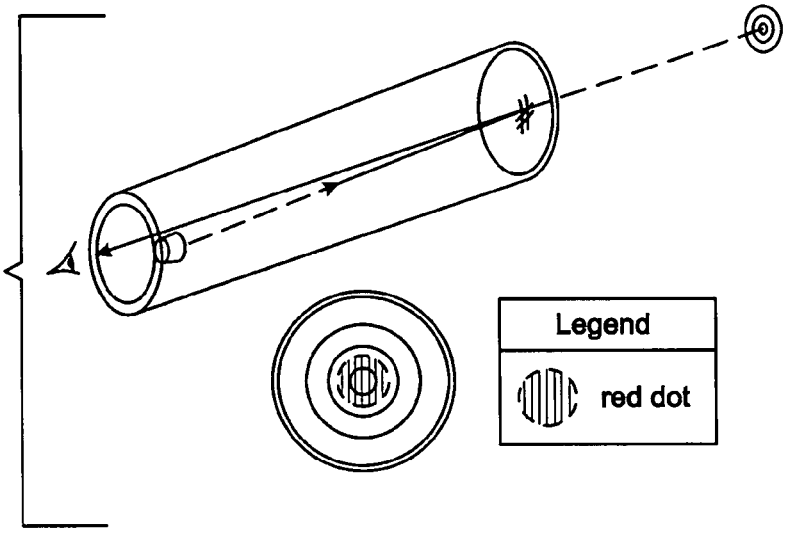
FIG. 4 (PRIOR ART)
FIG. 4 an illustration of the components of a red dot reflex type sight.
Figure 5:
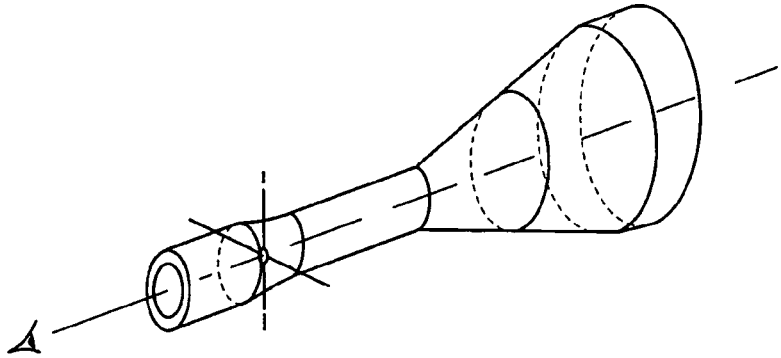
FIG. 5 (PRIOR ART)
FIG. 5 an illustration of the components of a telescopic sight including the reticle plane, in which the signal indicators of the present invention are located.

In another embodiment, both the direct illumination and indirect illumination indicator lights are provided simultaneously with the use of one or more LEDs, as shown in FIG. 4*b*.

Figure 10A:
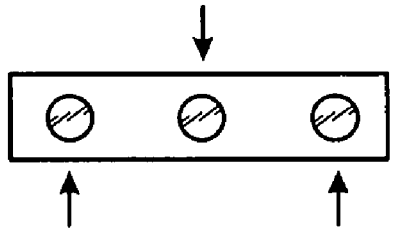
FIG. 10*a* is an illustration showing the use of multiple indicator lights to provide out-of-level direction information as used in one embodiment of this invention.

In yet another embodiment of this invention, multiple light sources provide indications not only of level conditions, but also the direction of tilt, either to the left or to the right from a zero cant angle. One preferred embodiment using multiple light sources on a bow sight would use, as shown for example in FIG. 10*a*, a green vertical indicator light to signal level, with a single red indicator light on each side of the central green indicator light, to indicate which way the device is tilted.

Figure 10B:
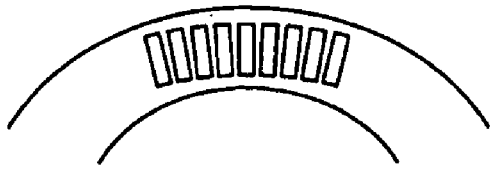
FIG. 10*b* is an illustration showing the use of an LED array indicator used in one embodiment of this invention to provide an analog equivalent of a bubble-type level.

Still another embodiment of this invention incorporates the use of a plurality of light sources configured into a linear or slightly curved array, whereby the degree of off-vertical tilt could be conveyed by the number or brightness of light sources illuminated to the left or right of the central light indicator. For example, as shown in FIG. 10*b*, the plurality of light indicators consists of an LED array, the central LED being a green light flanked on either side by two yellow LEDs, and further flanked by two or more red LEDs at the extreme ends of the array. When the instrument is level to within the preset range of error, the central green indicator light would emit light. When tilted slightly to the left, for example, one or two of the left-most yellow LEDs would emit. When tilted at larger angles to the left, for example, the one or more of the red LEDs would emit light, in proportion to the degree of tilt. In this way, the LED array simulates the analog mechanical action of a bubble-type level, while providing the enhanced accuracy of a digital electronic device.

Yet another embodiment of the present invention, the digital or analog output signals from the accelerometer provide feedback and control signals to a movable bow sight pin, leaf sight, red dot reflex sight LED, or reticle, so as to automatically adjust the positioning of such aiming devices to account for any canting of the weapon during the process of launching the projectile.

Figure 11A:
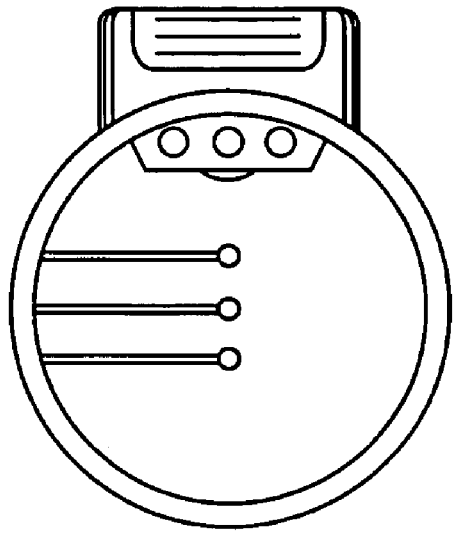
FIG. 11*a* is a cross-sectional perspective of one embodiment of the electronic digital vertical level indicator of this invention as attachable to a bow and bow-sight.
Figure 11B:
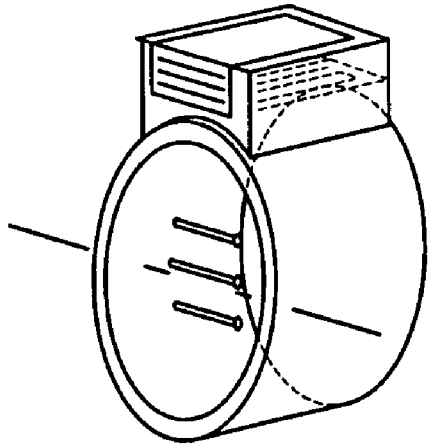
FIG. 11*b* is an oblique perspective of the embodiment in FIG. 11*a*.

In each preferred embodiment, a preferred location for the direct and indirect LED illuminators is within the field of view of the aiming device of the projectile launcher, and preferably in the far-field of the user's vision. In the case of a riflescope, for example, the level indicator lights would need to appear in the reticle of the scope. In the case of a bow sight, the illuminators would need to be positioned inside the sight housing, as shown for example in FIGS. 11*a* and 11*b*. FIG. 11*a* provides a cross-sectional perspective of one embodiment of the electronic digital vertical level indicator of this invention that is as attachable to a bow and bow-sight. FIG. 11*b* provides an oblique perspective of the embodiment in FIG. 11*a*. In this embodiment of the invention, indirect illumination is provided by an additional LED pointed downward toward the 3 sighting pins shown in the illustration.

Figure 1:
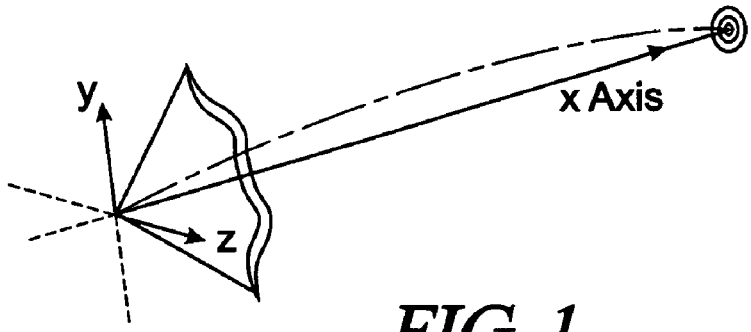
FIG. 1 (PRIOR ART)
FIG. 1 is an illustration of a bow aimed at a target, showing the target direction and trajectory of an arrow in relation to the coordinate axes used to describe the effect of tilting the bow in the plane perpendicular to the target direction.
Figure 2:
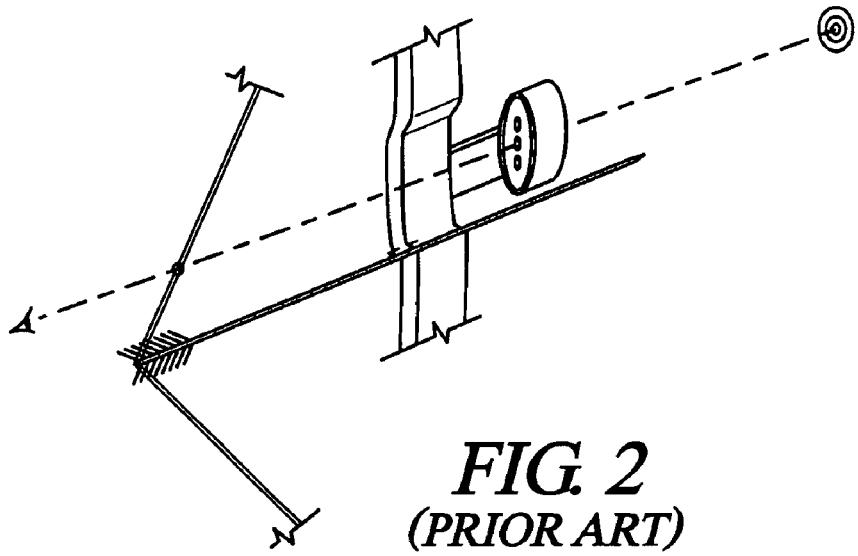
FIG. 2 (PRIOR ART)
FIG. 2 is an illustration of the components of a bow relevant to the problem of bow canting, showing the positioning of a bow sight-mounted level sensor.
Figure 3:
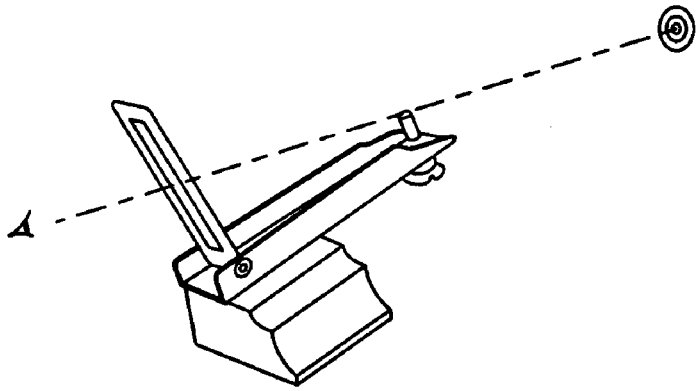
FIG. 3 (PRIOR ART)
FIG. 3 is a perspective view of a leaf sight mounted on a grenade launching device.
Figure 12:
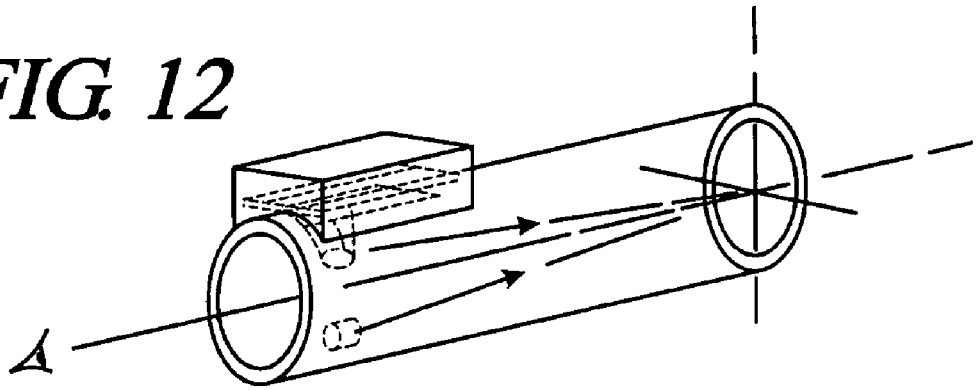
FIG. 12 an oblique perspective of one embodiment of the electronic digital vertical level indicator attached to a red dot reflex-type sight.
Figure 13A:
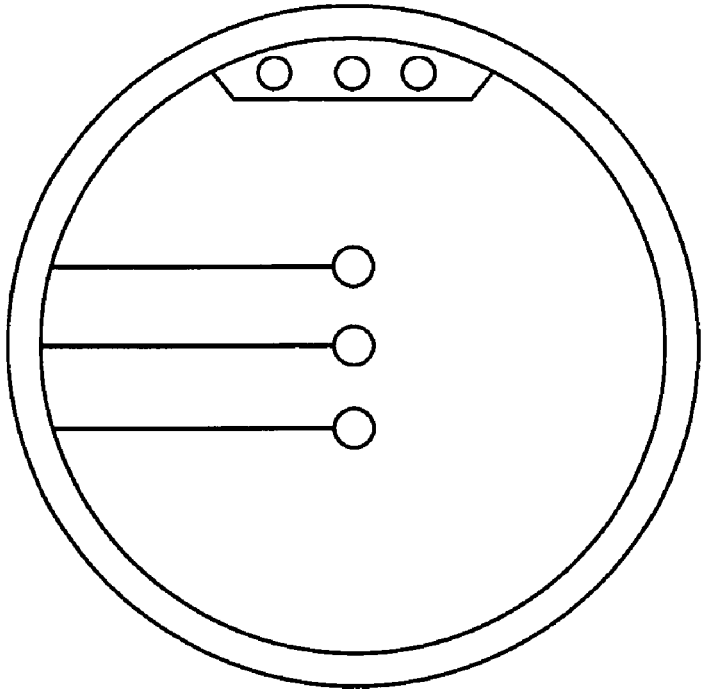
FIGS. 13 *a* and 13*b* are cross-sectional view of alternative embodiments of the embodiment shown in FIG. 12.
Figure 13B:
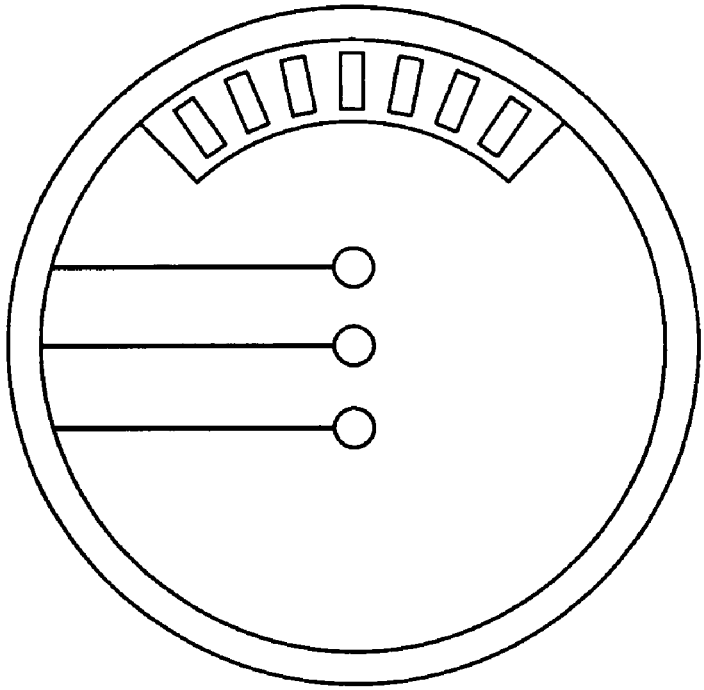

In another embodiment of the present invention shown in FIG. 12, an electronic digital vertical level indicator similar to the embodiments of FIG. 11*a* or 1*b* is shown attached to a red dot reflex-type sight or other similar optical system. Cross-sectional views of those embodiments as attached to a red dot reflex-type sight or other similar optical system are shown in FIGS. 13*a* and 13*b*, respectively.

In one preferred embodiment, the device has one or more buttons that are configured in communication with the microprocessor to provide one or more of the following features: a power on/off button, a button to reset the angle value that triggers the LED illumination, a button to set the intensity of the LED illuminators, a button to adjust the angular sensitivity of the device, and a button to separately cause the illumination to be always on, irrespective of whether the angle sensor is activated. The device can be configured to run off of any readily available battery, such as a single 3-volt lithium battery, a 1.5 volt AA battery, or a single 9 volt battery.

A digital vertical level indicator of one embodiment of the present invention is constructed using a ±2 g accelerometer and a microprocessor with a 12 bit counter. The resolution of 12 bits are sufficient to provide a reasonable level of accuracy for most hand held projectile launching devices, including bows, rifles, grenade launchers and mortars. This embodiment has an LED indicator which illuminates when the digital vertical level indicator senses that it is at the desired trigger angle or trigger angle range. The user has the ability to reset the trigger angle indicator and the selected trigger angle or trigger angle range with the press of a button. Using both the data of the output pulse period and the accelerometer pulse width's ratio, this embodiment of the invention compensates for data shifts due to changing temperatures. Output signals from the accelerometer circuit are provided to drive a feedback and control system for automatically adjusting the position of the sight to account for non-zero cant angles present at the time of firing the projectile. The device housing is miniaturized and is ideally suited to be mounted on a compound bow, and runs off of a 3 volt lithium battery.

Figure 14:
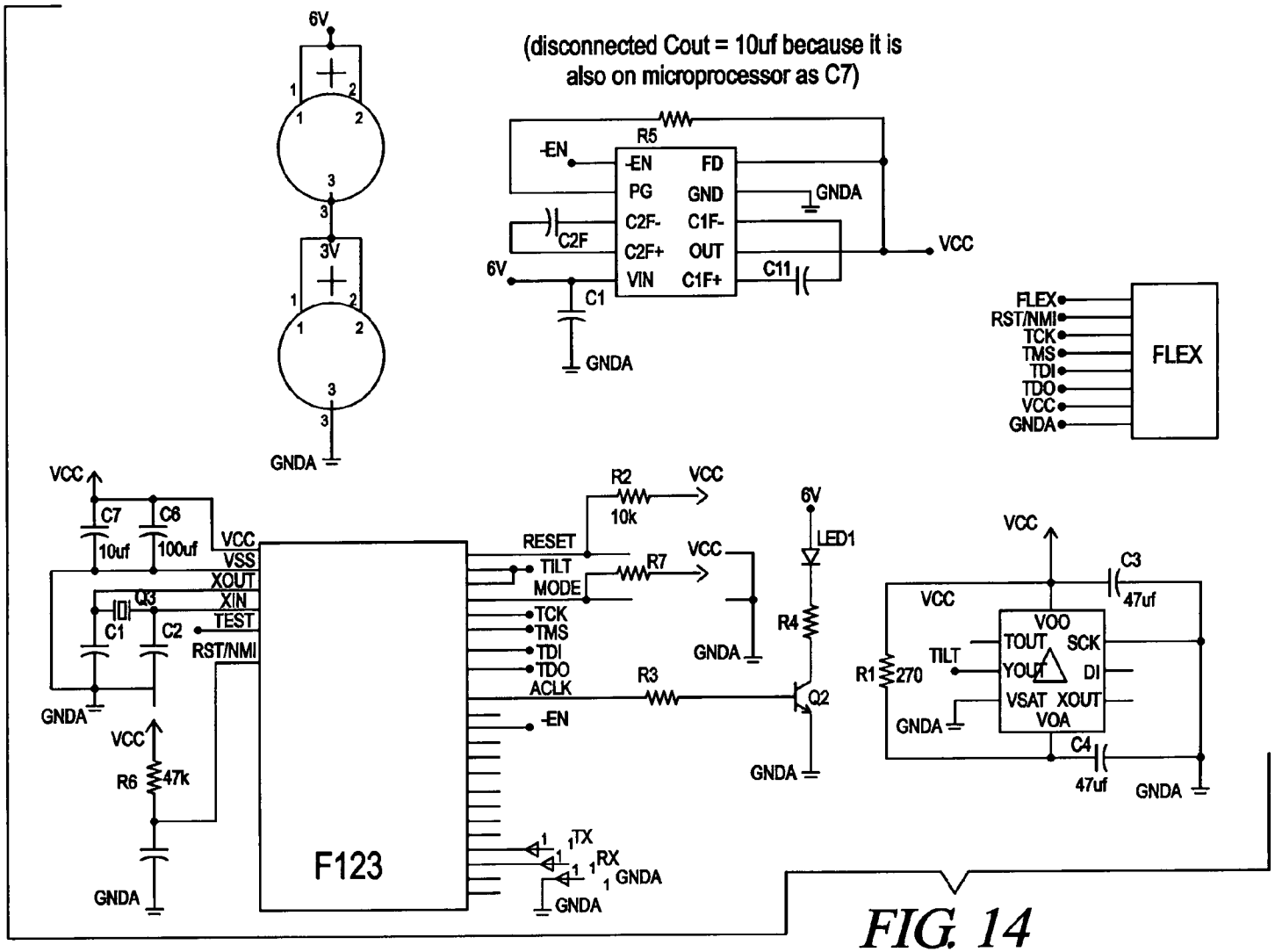
FIG. 14 is a circuit schematic of a preferred embodiment of the present invention.

A circuit schematic of one preferred embodiment is shown in FIG. 14.

Thus, although there have been described particular embodiments of the present invention of a new and useful Digital Vertical Level Indicator for Improving the Aim of Projectile Launching Devices, it is not intended that such references be construed as limitations upon the scope of this invention except as set forth in the following claims.

What is claimed is:

1. An apparatus for measuring and displaying a cant angle of a ballistic projectile launcher, said apparatus comprising:

a housing mounted on a sighting device of a ballistic projectile launcher, the projectile launcher defining a cant angle in a y-z vertical plane and defining a launch angle in a x-y vertical plane, the y-z vertical plane being orthogonal to the x-y vertical plane;

a microprocessor in communication with an electronic accelerometer, the microprocessor and the accelerometer disposed within the housing; and a vertical level indicator in communication with the microprocessor, wherein, the electronic accelerometer is adapted provide an accelerometer output signal that is proportional to displacement of the projectile launcher in the y-z vertical plane and independent of displacement of the projectile launcher in the x-y vertical plane, wherein, the microprocessor is adapted receive the accelerometer output signal and is further adapted to provide an illumination signal, the illumination signal being proportional to the cant angle and independent of the launch angle, and wherein, the vertical level indicator is adapted receive the illumination signal and is further adapted to provide an visual or audible signal to a user of the projectile launcher, the visual or audible signal having characteristics corresponding to the cant angle.

2. The apparatus of claim 1, wherein the vertical level indicator comprises an array of indicator lights disposed within the sighting device, and wherein, the indicator lights are illuminated to provide a visual signal proportional to the cant angle.

3. The apparatus of claim 2, the array of indicator lights including:

a central indicator light adapted to emit light of a first color; and at least a first pair of sequentially ordered flanking indicator lights, one of each pair of flanking indicator lights disposed on each side of the central indicator light in a sequence corresponding to the order of each pair, each pair of sequentially ordered flanking indicator lights adapted to emit light of a color selected to correspond to the order of each pair, wherein, the illumination of the central indicator light corresponds to a cant angle of approximately zero degrees from vertical, and wherein, the illumination of the ordered flanking indicator lights on one side of the central indicator light is in a sequence corresponding to the order of each pair so as to provide a visual signal proportional to the cant angle.

4. The apparatus of claim 3, wherein the projectile launcher comprises a bow and the sighting device comprises a bowsight mounted on the riser of the bow, and wherein, the array of indicator lights is disposed within the bowsight.

5. The apparatus of claim 3, wherein the sighting device comprises a red dot reflex sight having an objective lens or mirror defining a focal plane, and wherein the array of indicator lights is disposed within the focal plane of the sight.

6. The apparatus of claim 3, wherein the sighting device comprises a riflescope or telescopic sight having an objective lens defining a focal plane, the sight further having a reticle or crosshair disposed in the focal plane, and wherein the array of indicator lights is disposed within the focal plane of the sight.

7. The apparatus of claim 1, wherein the sighting device includes a movable aiming means, and wherein, the electronic accelerometer is adapted to provide feedback and control signals to the movable aiming means so as to adjust the positioning of such aiming devices so as to account for the cant angle.

8. The apparatus of claim 7, wherein the movable aiming means is selected from the group including a movable bow sight pin, a movable leaf sight, a movable red dot reflex sight, and a movable reticle.

9. The apparatus of claim 1, wherein the projectile launcher is selected from the group including a bow, a pistol, a rifle, a firearm, a grenade launcher and a mortar.

10. The apparatus of claim 1, wherein the projectile launcher comprises a bow and the sighting device comprises a bowsight mounted on the riser of the bow, and wherein, the vertical level indicator comprises an aiming pin disposed within the bow sight, the aiming pin adapted to emit or reflect a light having a level of brightness corresponding to the cant angle.

* * * * *